United States Patent [19]

Stimac

[11] Patent Number: 4,961,523

[45] Date of Patent: Oct. 9, 1990

[54] BUTTERFLY KNIFE SHEATH

[76] Inventor: William G. Stimac, 404 Inglewood, Vicksburg, Miss. 39180

[21] Appl. No.: 338,856

[22] Filed: Apr. 17, 1989

[51] Int. Cl.[5] ..... B26B 29/02; F41B 13/04

[52] U.S. Cl. ..... 224/232; 224/242; 224/904; 30/151; 30/155

[58] Field of Search ..... 224/232, 233, 235, 240, 224/242, 245, 250, 251, 252, 253, 904; 30/151, 153, 154, 155, 157, 164.5, 329

[56] References Cited

U.S. PATENT DOCUMENTS

| | | | |
|---|---|---|---|
| D. 251,569 | 4/1979 | Johnson | D22/14 |
| 3,246,813 | 4/1966 | Miller | 224/232 |
| 3,257,050 | 6/1966 | Smith | 224/242 |
| 3,524,570 | 8/1970 | Seguine | 30/151 |
| 3,958,330 | 5/1976 | Hutchens | 30/151 |
| 4,326,652 | 4/1982 | Fortenberry | 224/253 |
| 4,525,928 | 7/1985 | Foster | 224/232 |
| 4,759,483 | 7/1988 | Willoughby | 224/240 |
| 4,848,000 | 7/1989 | O'Dell | 224/232 |

OTHER PUBLICATIONS

Imada, Jeff and Foon, George; The Balisong Manual; pp. 23–32 (1984).

Imada, Jeff and Foon, George; The Advanced Balisong Manual; pp. 124–126 (1986).

*Primary Examiner*—Henry J. Recla

*Assistant Examiner*—Glenn T. Barrett

*Attorney, Agent, or Firm*—Leydig, Voit & Mayer

[57] ABSTRACT

A butterfly knife scabbard including a housing incorporating an aperture sized to engage the locking latch of the knife handle to release the knife from the chambered position for facilitating actuation of thereof and method for its use.

6 Claims, 2 Drawing Sheets

BUTTERFLY KNIFE SHEATH

TECHNICAL FIELD

This invention relates to a knife scabbard and, more particularly, a butterfly knife scabbard facilitating actuation of the knife.

BACKGROUND OF THE INVENTION

The butterfly knife is an old and well-known Asian knife structure. While its ancestry has been traced as far back as 800 A.D., it first surfaced in America in the early part of the Twentieth Century. It is believed that the first butterfly knives were brought to the United States by Asian immigrants and later, popularized by military personnel returning from the South Pacific after World War II. It is now one of the more popular existing knife designs as is evidenced by its frequent use in feature films such as, "Sharkey's Machine," "The Outsiders," and "Silent Rage."

In brief, a butterfly knife comprises; a blade, two isomeric handle halves, each of a thickness approximating half the blade width and each rotatably connected to the blade tang (base of the blade) with pins. The tang also features a pin (tang pin) to stop rotation of the handle halves upon blade exposing movement. Finally, the knife includes a locking latch that in one position secures the handle halves over the blade and in a second position locks the handle halves together as a handle from which the blade projects. To use the knife, the locking latch is released from the first blade covering (chambered) position. The user grips the blade half closest to the palm of the hand between the thumb and fingers and flicks the wrist. As the wrist is flicked, rotational energy is imparted to the second handle half and the blade which both rotate about the pin securing the first handle half to the tang. As the blade and second handle half move through the arc of rotation to where the blade projects 180° from the chambered position (sticking straight out from the first handle half), its rotation is stopped by the tang pin. The second handle half continues to rotate relative to the tang due to its own rotatable pin connection and completes a virtually full circle to abut the first handle half. The combined movement can be fairly characterized as joint articulated rotation. Thus, in the final configuration, the blade projects from a bifurcated handle formed by the handle halves and the locking latch is locked to establish a unitary handle structure.

One of the well-known benefits of the butterfly design, believed to have contributed to its popularity, is that the two legs of the folding handle (handle halves) cover and protect the blade when the knife is in rest (chambered) position. Thus, the butterfly knife is unique in eliminating the need for a blade protecting sheath. However, the absence of a sheath creates its own problems. For example, if the user does not employ a sheath then the knife must be stored somewhere on the person. Often, such storage, if reasonably secure, detracts from and otherwise affords only marginal quick access, i.e. a pocket, a sock, etc. Not only does such placement impede access but also it reduces the speed at which the knife can be opened.

SUMMARY OF THE INVENTION

It is an object of the instant invention to provide a scabbard for a knife particularly suited for a butterfly knife.

It is a further object of this invention to provide an ornamental design for a knife scabbard.

Still another object of this invention is to provide a scabbard for securing a butterfly knife.

Yet another object of this invention is to provide a sheath operative to assist with actuation of a butterfly knife.

It is a further object of this invention to provide a method for actuating an interlocking knife and scabbard.

Another object of this invention is to provide a sheath/knife combination such that the knife can be rendered operable by releasing and pivoting the knife relative to the sheath.

These and other objects are satisfied by a knife sheath for use with a knife incorporating an actuating latch for release of the latch projecting from the knife, comprising:

a housing having at least a first wall, said housing having a cavity dimensioned to receive at least a portion of the knife, and means for engaging the actuating latch where said means for engaging the actuating latch actuates release of the knife upon moving the knife portion contained in said cavity, relative to said wall.

Still other objects are satisfied by a method of using a knife and scabbard combination comprising the steps of:

(a) selecting a knife having rotatable handle halves capable of chambering the blade and having a locking projection extending from one of the handle halves;

(b) selecting a scabbard having front, rear, side and bottom walls defining an aperture dimensioned to receive at least a portion of the knife and the locking projection;

(c) inserting the knife into the scabbard and engaging the locking projection with the scabbard opening;

(d) moving the knife through the opening and disengaging the locking projection.

In a narrow sense, this invention contemplates a sheath/knife combination where the knife is a butterfly knife having a pivotable lateral projection protruding from the handle. The locking projection fits into an aperture configured to receive it which is formed in the scabbard. When the locking latch of the knife is engaged with the aperture, as the user removes the knife from the sheath, the latch pivots to release the knife.

The sheath disclosed in the instant invention allows the user to carry the knife on a belt while also providing for quick and easy access. More importantly, the sheath provides a cooperating unlocking means to eliminate a knife actuating step. In other words, removal from the sheath and unlocking the handle halves is achieved in one motion. Thus, the user is saved from wasting time when employing the knife.

Further objects and advantages of the instant invention will be apparent from the following description of the drawings and detailed description of the drawings.

DETAILED DESCRIPTION OF THE DRAWINGS

Figure 1:
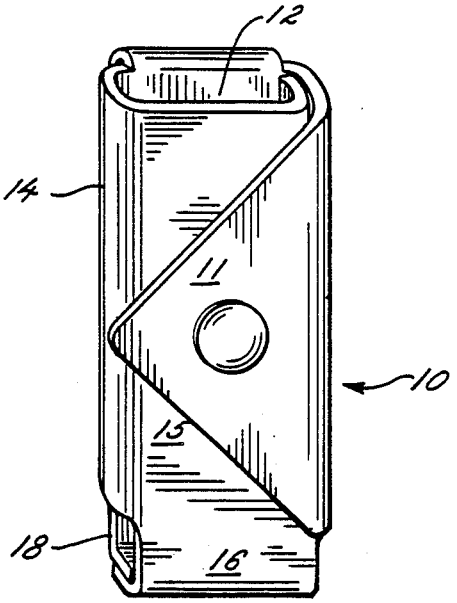
FIG. 1 is a front elevation view of a scabbard in accordance with this invention.

Referring to FIG. 1, there is shown substantially cylindrical knife scabbard 10, featuring cavity 12 having generally rectangular cross-sectional configuration defined by front, back and side walls. More particularly, scabbard 10 includes rear wall 13, side wall 14, front wall 15, bottom wall 16 formed by overlapping flaps 17. Scabbard 10 preferably is constructed from substantially rigid but deformable leather (100 mil+) for strength, durability and an attractive appearance. Of course, many modern synthetic textile materials provide equally satisfactory physical characteristics and as such, the construction of the scabbard 10 is not limited to leather.

Figure 2:
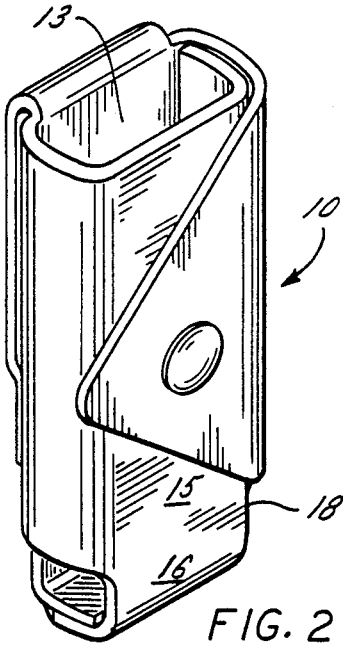
FIG. 2 is a side elevation view of the scabbard of FIG. 1.
Figure 4:
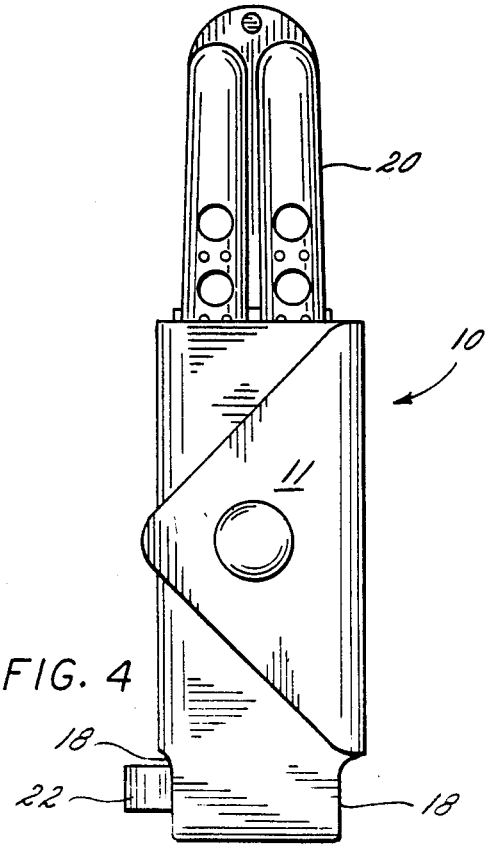
FIG. 4 is a front elevation view of the scabbard of FIG. 1 with the knife inserted therein and the vertical projection, associated with the knife in the looked position.

FIG. 2 illustrates how overlapping flaps 17 and side wall 14 form two notches 18 which effectively define a transverse aperture. Notches 18 are dimensioned to cooperate with rotatable locking latch 22 (defining a lateral protrusion on one handle half). Simply put, latch 22 seats snugly in notch 18 (see FIG. 4). The butterfly knife is chambered (secured) in scabbard 10 in a manner where rotatable latch 22 is securely seated in notch 18. Deformable front flap 11 is snapped closed, and it, along with the interacting notch 18 and latch 22, prevents knife 20 from slipping from the seated position under normal carrying conditions. In the event the knife, while chambered, bears a tapered configuration (see FIG. 4), and cavity 12 conforms to the taper, it should be readily apparent that the complimentary matching wedge structures coact to enhance the chambering capacity of the knife.

Scabbard 10 facilitates user access to the knife blade with a simple single motion. Upon unsnapping front securing flap 11, the knife is pivoted forward through the flap opening about latch 22. Pivoting the knife while notch 18 retains latch 22 in a relatively stationary position, unlocks the handle halves. Once so unlocked and released from the scabbard, the user merely employs the basic butterfly knife blade exposing motion (described above). The foregoing actuation facilitation occurs only when locking latch 22 is secured within notch 18 formed in the opposite wall from flap 11. If in the notch on the same side, the knife will not be actuated and, therefore, storable in a neutral condition.

Figure 3:
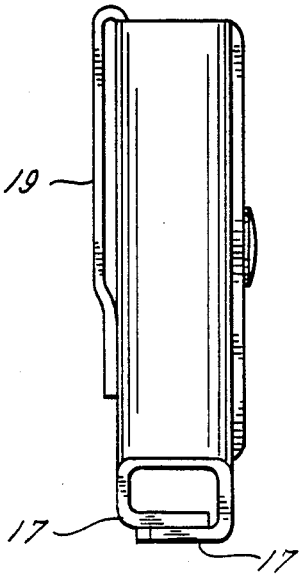
FIG. 3 is a direct side view of the scabbard of FIG. 1.

Referring to FIG. 3, it features belt loop 19 intended for the convenience of the user. The user is free to wear the sheath on a waist belt. Of course, several other suitable attachment structures are readily adapted for use with the invention; resilient clips, Velcro ®, etc.

Given the principles of use of scabbard 10, it should be appreciated that, if properly dimensioned, knife 20, e.g. a Philippine style with straight handle halves, can be unlocked from the chambered position and freed from scabbard 10 to permit exposure of the blade by translating the knife relative to cavity 12. As the knife slides relative to the cavity, latch 22 is pivoted in respect to the knife base. Thus, if strapped to the wrist, knife 20 can be released into the hand from the scabbard and unlocked with one forceful jerk of the forearm. In the event of either of the described constructions and uses, scabbard 10 is readily usable as a portable carrying case placed in a pocket, wedged in a waistband or simply carried in the user's hand.

Figure 5:
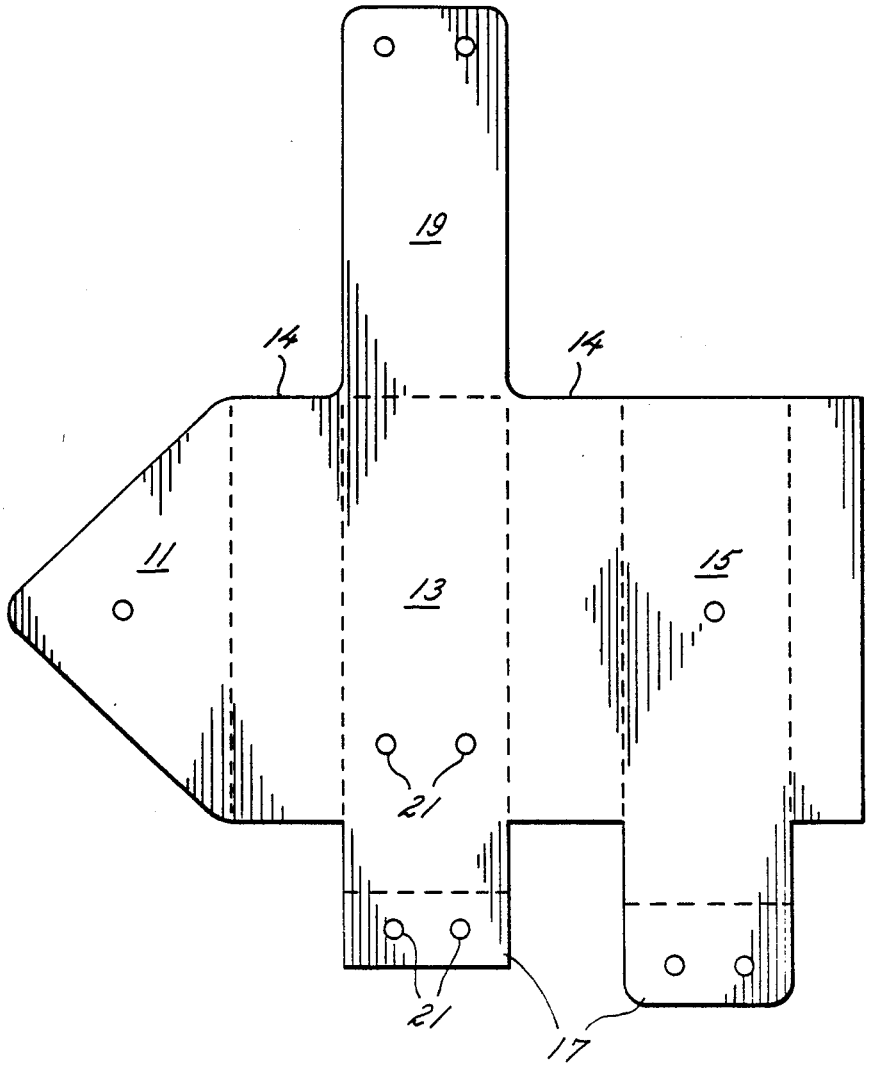
FIG. 5 is a top view of a pattern employable to form the scabbard of FIG. 1.

FIG. 5 provides a pattern (not actual size) for a scabbard of the type illustrated in FIG. 3. A pattern of this type is employed when the scabbard is constructed from a single piece of leather. The areas corresponding to those identified above are appropriately labeled. Holes 21 are provided to accommodate rivets, fasteners and the like for assembly. One simple assembly route consists of folding member 19 over wall 13 and riveting the two together to form the loop. Likewise, the remainder of the pattern is folded along the dotted lines in a manner where flaps 17 overlap and are riveted together.

Although the description has focused on the use of a traditional butterfly knife, the application of this invention is not limited to use with a traditional butterfly knife. The invention can be employed as a protective sheath with any knife having a lateral projection protruding from the handle.

The illustrated embodiment having been described, it should be noted that numerous variations, modifications and other embodiments will become apparent to a person having ordinary skill in the art.

I claim:

1. A knife sheath adapted for use with a butterfly knife having a blade, a handle having two movable legs, each having a first end pivotally attached to said blade and each having an opposite end, a pivotable actuating latch operatively associated with each opposite end which latches the legs together and pivots to release the legs from each other, said latch extending laterally from said handle when in a latched position, said knife sheath comprising:

a housing having at least a first wall wherein said housing forms a cavity having an open top and a closed bottom and dimensioned to receive at least a portion of said knife with said opposite ends of said handle adjacent said bottom; and means for engaging the pivotable actuating latch of said butterfly knife, said means including a notch formed in said first wall of said housing adjacent said latch wherein said means secures the knife within the housing when said knife is placed in said cavity and upon removing said knife from said cavity, said means causes said actuating latch to pivot thereby releasing the blade.

2. A knife sheath according to claim 1 wherein the wall defines a flap and further comprises a snap means for securing the wall to the housing.

3. A knife and scabbard in combination, comprising:

a knife having a generally planar blade and a handle, said handle having two movable legs which are capable of chambering the blade, one of said legs having a lateral projection extending in the plane of the blade;

a scabbard in the shape of a cylindrical housing having front, side, bottom, an open end, and rear walls, an aperture disposed along the side walls, said aperture being transverse to the axis of the housing;

said aperture and said lateral projection forming a latch connection defining a lock.

4. The combination of claim 3 wherein the scabbard includes a forwardly disposed securing flap and rearwardly disposed belt attachment means.

5. The combination of claim 4 wherein the belt attachment means is a strap fixedly connected to said housing at said first end, extending longitudinally along the rear of the housing and fixedly connected near the aperture.

6. The combination of claim 3 wherein said knife is a butterfly knife.

* * * * *